US007111547B1

(12) United States Patent
Daniel

(10) Patent No.: US 7,111,547 B1
(45) Date of Patent: Sep. 26, 2006

(54) METHOD AND APPARATUS FOR WIRE GUIDE WEAR PLATE

(75) Inventor: Barton W. Daniel, Kennesaw, GA (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 11/135,250

(22) Filed: May 23, 2005

(51) Int. Cl.
*B65B 13/06* (2006.01)
*B65B 13/20* (2006.01)

(52) U.S. Cl. ..... 100/3; 100/25; 100/34; 242/615.3

(58) Field of Classification Search ..... 100/2, 100/3, 8, 25, 26, 33 R, 34; 140/73, 93 A, 140/93.2, 101, 111; 226/196.1; 242/615.3, 242/615.4; 289/1.5, 2
See application file for complete search history.

(56) References Cited

U.S. PATENT DOCUMENTS 3,147,581 A * 9/1964 Godderidge ..... 57/58.63
3,691,939 A 9/1972 Goodley
3,863,558 A * 2/1975 Trumbo ..... 100/33 R
5,816,140 A 10/1998 Hart
6,363,843 B1 4/2002 Daniel et al.
6,553,900 B1 4/2003 Daniel et al.
6,628,998 B1 9/2003 Stamps et al.
6,633,798 B1 10/2003 Daniel et al.
6,637,324 B1 10/2003 Stamps
6,705,214 B1 3/2004 Stamps
6,711,994 B1 3/2004 Daniel et al.
6,837,155 B1 1/2005 Daniel et al.

* cited by examiner

*Primary Examiner*—Daniel C. Crane
*Assistant Examiner*—Jimmy T. Nguyen
(74) *Attorney, Agent, or Firm*—Husch & Eppenberger, LLC; Grant D. Kang

(57) ABSTRACT

A tying device and method of assembling same is disclosed. The tying device has a wire guide member adapted for mounting on an upper platen of a baling press. The wire guide member includes a top wall and side walls depending laterally from the top wall to form a channel. A door is pivotally mounted to one of the side walls, and the door having an inner, forward edge extending generally perpendicular to the side walls for guiding the wire tie into the channel. A removable wear insert is mounted to one of the side walls and has a cutout adapted to receive a portion of the door.

12 Claims, 7 Drawing Sheets

METHOD AND APPARATUS FOR WIRE GUIDE WEAR PLATE

CROSS-REFERENCE TO RELATED APPLICATIONS

None.

BACKGROUND OF THE INVENTION

1. Field of the Invention

This invention relates generally to the field of baling presses and more particularly, to an improved wire tie guide and tying device for a baling press and a method of assembling the wire tie guide.

2. Related Art

Wire baling of bulk materials has benefited from increased speed and reduced material cost through automation. Bulk materials include fibrous bulk materials, such as cotton and nylon. Fibrous materials are commonly formed into bales by simultaneous compression and binding. There is a continuing need in the automated baling art to improve the efficiency, reliability and accuracy of the bale binding process.

Baling wire performance requirements vary depending upon the bulk material being baled. Such requirements range from industry standard specifications to general operational parameters, such as minimum speeds required for profitability. The Cotton Council issues baling constraint standards specifying particular ranges for the length of wire around the bale and the tension that the wire must withstand. These ranges correspond to the weight, volume and compression of various standard bale sizes such as "universal density" or "standard density" bales.

Current automated baling machines use an articulated track to guide wire around bales of bulk material, such as cotton, while the bale is under compression. Material to be baled is typically introduced into the automatic baler under vertical compression. Typical pressures for an industry standard 500 pound, 20×54 inch bale of cotton are in excess of 300 tons. Horizontal plates called follower blocks apply compression through platens which contact the surface of the cotton or other material being compressed. The platens incorporate slots which run lateral to the longitudinal axis of the bale. The Industry Standard number of binding wires for the most common kind of cotton bale, the standard density bale, is six. Accordingly there are six slots in the platens to allow the baling wire to be wrapped around the bale while it is still under compression. Under the lateral slots are lateral channels for insertion of wire guide track sections in both the upper and lower platens in automatic balers.

U.S. Pat. No. 6,363,843 issued to Daniel et al. on Apr. 2, 2002, herein incorporated by reference, discloses a bailing press having a plurality of modular wire guide members connected to the upper platen. As shown in FIG. 1, each wire guide member 44 includes a generally U-shaped channel 48 bounded by a top wall 54 and parallel side walls 56, 58 which depend laterally away from the top wall 54 in a generally perpendicular direction. Each wire guide member 44 also includes a door 64 pivotally mounted on a shaft 66 within a cut-out or slot 68 in the one side wall 58. The door 64 is resiliently biased to a closed position by a spring 70. When in the closed position, the door 64 has an outer surface 72 that is generally co-planar with the bottom surfaces 74 of the side walls 56, 58.

While the modular wire guide member of the '843 patent has vastly improved the state of the art, some problems still remain. In particular, contact between the door 64 and the side wall 56 of the modular wire guide may lead to considerable wear of the side wall 56. If the wear is significant or if the wear creates a burr on the wire guide member, the bailing machine must be shut down for removal and repair of the damaged wire guide member. This is because significant wear may prevent the knot from slipping out properly. If the knot does not slip out properly, the bale of fibrous may hang or "stick" to the upper platen. A hanging bale of fibrous material presents a dangerous situation in that the bale could pivot from the upper platen and swing outwardly to injure passerby.

Additionally, a burr on the wire guide member may catch upon the knot, thereby decreasing its reliability. To remove the damaged wire guide for deburring requires that the entire baling machine be shutdown. If the burr is significant, then the wire guide member may need to be heat treated after it is deburred. Such a process is time consuming, inefficient and expensive.

Finally, the dimensional stability of the chamber where the knot is formed is crucial to obtain consistent high-quality knots. If the wire guide member door shuts too much or too little, then the wire ends will not engage properly to form the knot. As an example, the wire ends may straighten out such that the wire ends interlock as two fish hooks. In that case, the wire must be scrapped, and the bale must be manually fastened, which is inefficient.

In addition to knot quality, unscheduled work stoppage due to problems with the wire guide member is very costly. Stopping the baling machine severely reduces productivity and greatly increases costs of production due to labor costs. Therefore, it would be beneficial to have a maintenance device to allow for scheduled maintenance of the wire guide member.

Thus, there is a continuing effort to provide a more reliable and easy to operate tying device by further simplifying the manipulations required by the user. Further, there is a need in the art for an economical device to address the issue of wear to the side wall as a result of contact between the wire guide member door and the side wall.

SUMMARY OF THE INVENTION

The present invention provides an improved design of a bale wire tying device which very reliably facilitates engaging the looped ends of the wire tie into a proper knot. Further, the bale wire tying device of the present invention is modular in construction, thereby permitting the tying device components to be replaced independently of the wire guide itself. Further, the tying device of the present invention has the further advantages of providing a simple, durable, low cost structure that is easier to use, more economical to service and overall provides a more user friendly operation.

In accordance with the principles of the present invention and in accordance with the described embodiments, the present invention provides a removable wear insert for attachment to a wire guide member. Previously, the door of the discharge chamber would wear against the sidewall of the wire guide member. The present invention resolves this problem by providing a wear insert that can be quickly and easily replaced. The wear insert cooperates with the door to form a portion of the discharge chamber. The wear insert includes a cutout that receives a portion of the door. In this manner, the dimensions of the discharge chamber can be accurately maintained in a cost effective manner by replacing the removable wear insert as required.

Thus, in furtherance of the above goals and advantages, the present invention is, briefly, a baling wire tying device to facilitate guiding a wire tie around a bale of material being compressed between upper and lower platens of a baling press wherein the wire tie has pre-formed looped ends being engageable with each other to form a knot by moving one looped end relative to an opposite looped end, the tying device comprising: a wire guide member adapted to be mounted on the upper platen of the baling press, the wire guide member including a top wall and side walls depending laterally from the top wall to form an elongated, longitudinally extending generally U-shaped channel, the channel having forward and rearward end portions, and a bottom wall intersecting one of the side walls to form a longitudinally extending wire discharge passage contiguous with the channel; a door pivotally mounted proximate to one of the side walls at the forward end portion of the channel, the door in a closed position having an unobstructed inner surface substantially parallel to the top wall and extending across the discharge passage to form a portion of the bottom wall, and the door having an inner, forward edge extending generally perpendicular to the side walls for guiding the wire tie into the channel; and a removable wear insert mounted to one of said side walls at the forward end portion of the channel and having a cutout adapted to receive at least a portion of the door.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
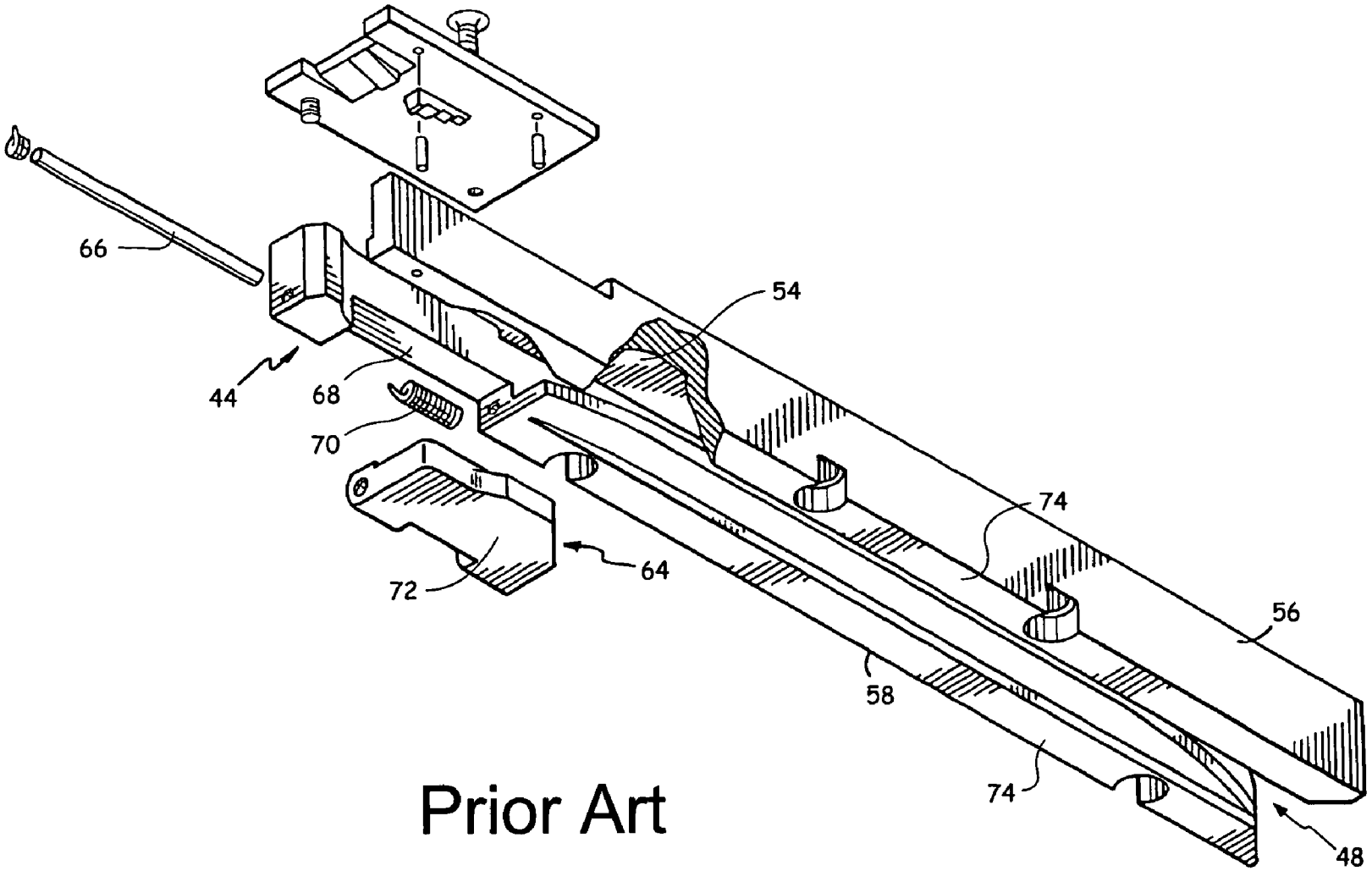
Fig. 1 Prior Art
FIG. 1 is a schematic view of a wire guide member as known in the prior art.
Figure 2:
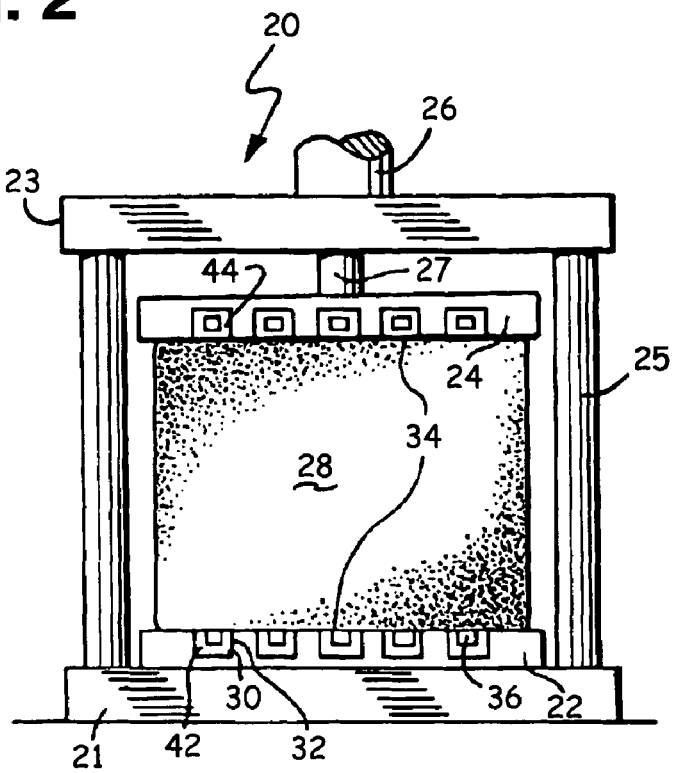
FIG. 2 is a schematic diagram of a front elevation view of a baling press with which the present invention is used.

Referring to FIG. 2, a baling press 20 is schematically illustrated as having a stationary lower frame member 21 supporting a stationary lower platen 22 and a stationary upper frame member 23. The lower and upper frame members 21, 23 are connected by two tie bars 25 to form a rigid frame structure. The upper frame member 24 supports a hydraulic cylinder 26 having a piston 27 connected to a movable upper platen 24. The hydraulic piston and cylinder unit 26 functions to move the upper platen 24 in a generally vertical direction with respect to the lower platen 22, and thus, the baling press 20 is suitable for compressing material, for example, cotton, into a bale 28.

Figure 3:
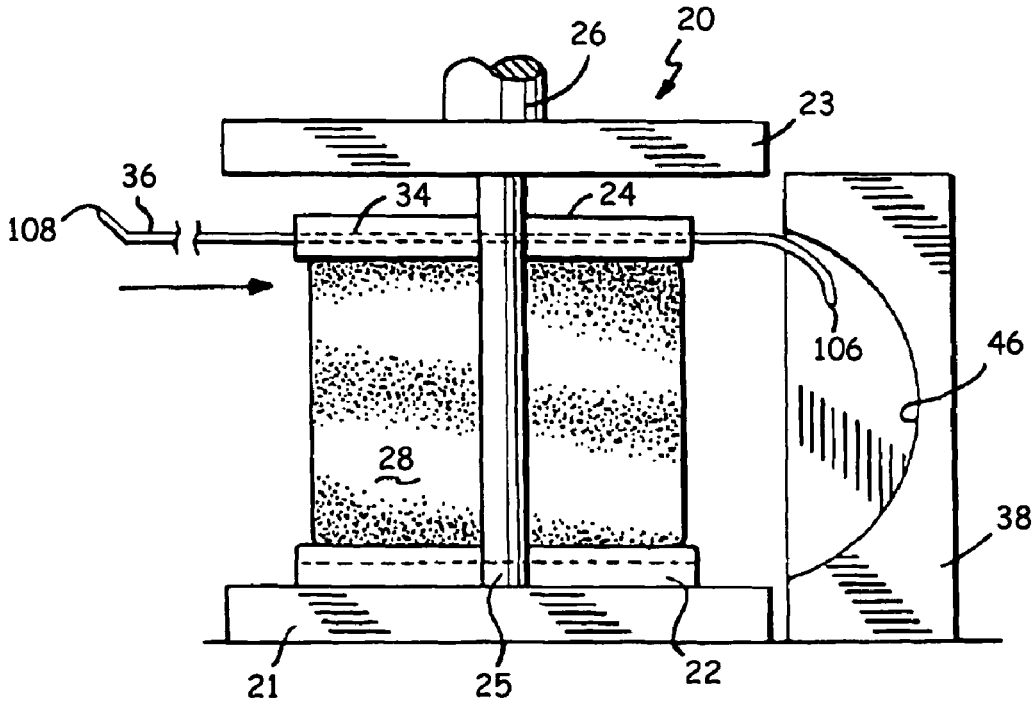
FIG. 3 is a schematic side elevation view of the baling press of FIG. 2.
Figure 4:
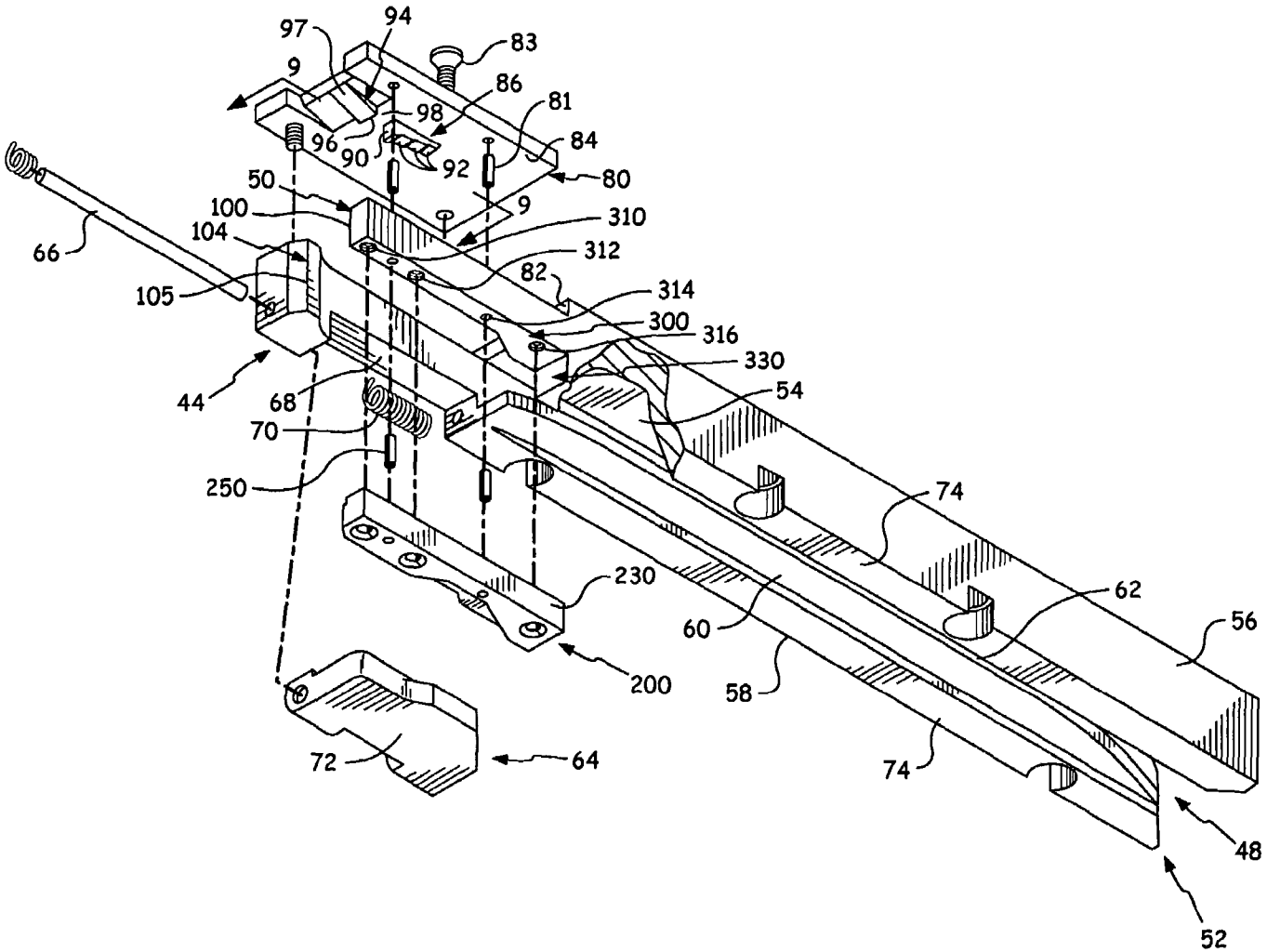
FIG. 4 is a disassembled perspective view of a bale wire tying device in accordance with the principles of the present invention.

A plurality of opposing pairs of wire guide members 30 are mounted in slots 32 that extend between the front and rear of the press 20 in the lower and upper platens 22, 24. The wire guide members 30 provide wire guide channels 34 that facilitate guiding wire ties 36 around the bale 28. Referring to FIG. 3, the baling press 20 includes a chute 38 placed at the rear of the platens 22, 24. The chute 38 includes a curved wire path 40 that extends between the rear ends of the lower and upper platens 22, 24, respectively. The curved path 40 permits the wire tie 36 to be fed through the channel in the upper platen 24 across the rear of the baling press 20 by means of the curved path 40 and through the channel 34 in the lower platen 22 back to the front of the baling press 20.

Referring to FIG. 2, each pair of opposed wire tie guide members 30 includes a pass-through channel member 42 located in one of the platens, for example, the lower platen 22, and a wire tying guide member 44 located in the opposite platen, for example, the upper platen 24. The pass-through channel member 42 simply provides an unobstructed U-shaped channel 34 through which the wire tie 36 readily passes. The structure of each of the wire tying guide members 44 is illustrated in further detail in FIGS. 4–7. The wire tie guide member 44 is very similar to that of the '843 patent. In fact, many of the components are the same. The wire tie guide member 44 has a generally U-shaped channel 48 extending between the front or forward end portion 50 and the rear end portion 52. The channel 48 is bounded by a top wall 54 and parallel side walls 56, 58 which depend laterally away from the top wall 54 in a generally perpendicular direction. A bottom wall section 60 extends from the lower edge of one of the side walls 58 in a perpendicular direction and generally parallel to the top wall 54. A wire tie discharge passage 62 is formed between the edge of the bottom wall section 60 and the opposite side wall 56. In the depicted embodiments, the wire guide member 44 is about twentyone inches (533 mm) in length, about two and three-eighths inches (60 mm) in width, and about one and one-half inches (38 mm) in height.

Figure 6A:
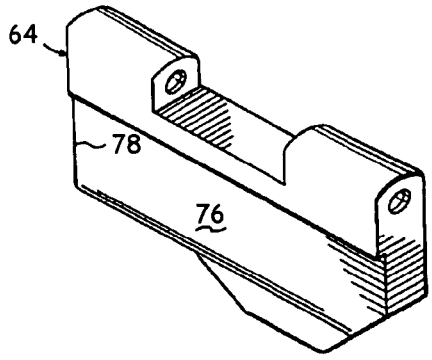
FIG. 6*a* is a perspective view illustrating the inner side of the door used in the tying device of the present invention.

A door 64 is pivotally mounted on a shaft 66 within a cut-out or slot 68 in the one side wall 58. The door 64 is resiliently biased to a closed position by a spring 70. When in the closed position, the door 64 has an outer surface 72 that is generally co-planar with the bottom surfaces 74 of the side walls 56, 58. Further, when in the closed position, the door 64 extends across and blocks the wire discharge passage 62 at the front end 50 of the tying device 44. As shown in FIG. 6*a*, the door 64 has an unobstructed flat inner surface 76 that terminates at an inner forward edge 78.

A removable plate 80 is mounted in a cut-out or notch 82 at the front end of the wire guide member 44 using locating pins 81 and fasteners 83. The plate 80 has an inner surface 84 that is generally co-planar with the top wall 54. The removable plate 80 has a first stop 86 that is mounted on the surface 84 close to a longitudinal center line 88. The first stop 86 includes a forward directed surface 90 and a rearward stepped surface formed by a plurality of surfaces 92 rearward of the surface 90 that step toward the surface 84. A second stop 94 is located forward of the first stop 86 and is also close to the longitudinal center line 88. The second stop 94 has a rearward directed surface 96 that depends generally perpendicularly from the top surface 84 and is generally aligned with the inner forward edge 78 of the door 64. The second stop 94 further has a flat, generally rectangular angled or sloped surface 97 that extends forward of the outer edge of the surface 96 and slopes toward the top surface 84. A notch 98 for receiving the second looped end of the wire tie 36 is formed between the forward directed surface 90 of the first stop 86 and the rearward directed surface 96 of the second stop 94.

The channel 48 at the front end 50 is widened by a surface 100 that is cut into or offset into the side wall 56. The wider channel formed by the surface 100 accommodates the two looped ends of the wire tie. The entrance at the front end 50 into the channel 48 is narrowed by a lateral projection 104. The lateral projection 104 has an edge or surface 105 opposite the surface 100 that extends between the top surface 84 and the side wall bottom surface 74.

Figure 6B:
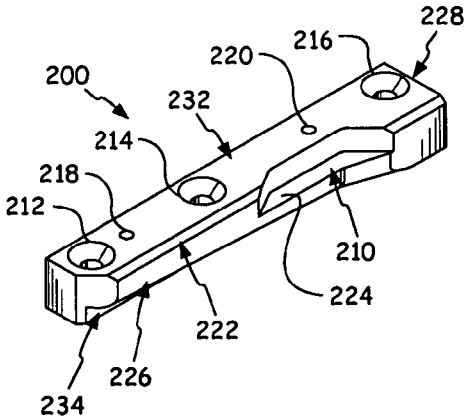
FIG. 6*b* is a perspective view illustrating the replaceable wear insert in the tying device of the present invention.
Figure 7:
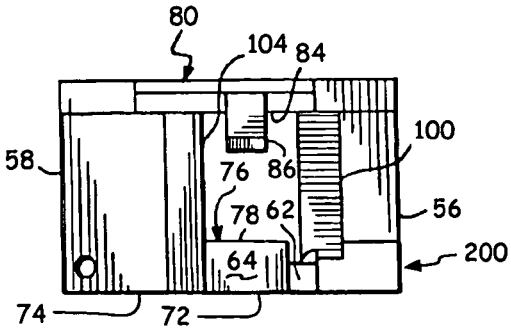
FIG. 7 is a forward end view of the tying device of the present invention illustrated in FIG. 4.

The wire guide member 44 further includes a removable wear insert 200. The removable wear insert 200 is mounted to the side wall 56. The removable wear insert 200 includes a cutout 210 (as best seen in FIG. 6*b*) which receives the door 64. The removable wear insert 200 is designed to wear in place of the door 64 or the side wall 56. In this manner, there is provided a component that can be readily replaced as required to maintain the dimensions of the knot discharge chamber. The removable wear insert 200 may be made from various materials. As an example, the removable wear insert 200 may be made from A2 tool steel and hardened to 55–60 on the Rockwell "C" Scale. Further, the removable wear insert 200 may be of any various shapes and sizes. As an example, the removable wear insert 200 may be about 4.18 inches (106 mm) in length, about 0.75 inches (19 mm) in width, and about 0.53 inches (13 mm) in height.

Figure 5:
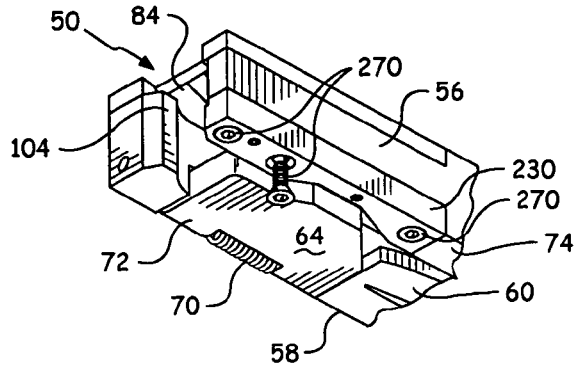
FIG. 5 is a partial perspective view of the assembled tying device illustrated in FIG. 4.

The removable wear insert 200 is mounted to the side wall 56. In the depicted embodiment, the removable wear insert 200 is mounted through the use of alignment pins 250 and fasteners 270 (as best seen in FIG. 5). The fasteners 270 may be of any shape or size but are flat head cap screws in the depicted embodiment. While three fasteners 270 are shown in the depicted embodiments to secure the removable wear insert 200 to the side wall 56, those skilled in the art will understand that a greater or lesser number of fasteners may be used. Further, the alignment pins 250 also may be of any size or shape but are roll pins in the depicted embodiment. While two alignment pins 250 are shown in the depicted embodiments to locate the removable wear insert 200 relative to the side wall 56, those skilled in the art will understand that a greater or lesser number of alignment pins may be used.

As best seen in FIG. 6*b*, the removable wear insert 200 includes the cutout 210 to receive a portion of the door 64. The removable wear insert 200 includes a contact surface 224. In the depicted embodiment, the contact surface 224 is located about 0.250 inches (6 mm) below a top surface 232 of the removable wear insert 200. The door 64 contacts or engages the contact surface 224 when the door 64 is in a closed position. The removable wear insert 200 also includes through holes 212, 214, and 216. In the depicted embodiment, the through holes 212, 214, and 216 include a taper to receive a flat head cap screw. The removable wear insert 200 also includes alignment holes 218, 220. The alignment holes 218, 220 receive the alignment pins 250 and help locate the removable wear insert 200 relative to the door 64 and the sidewall 56. In the depicted embodiments, the alignment holes 218, 220 are 0.120 inches (3 mm) in diameter. The removable wear insert 200 also includes a bottom surface (not shown) opposite the top surface 232. The removable wear surface further includes a channel 234, an inner guide surface 226, and an end surface 228. In the depicted embodiment, the channel 234 has a three degree downward slope, and the inner guide surface 226 is about 0.625 inches from a face 230 of the removable insert 200. When mounted, the top surface 232 is generally co-planar with the bottom surfaces 74 and the outer surface 72.

Referring to FIG. 2, the bottom surface of the removable insert 200 mates with a first mounting surface 300 of the side wall 56 and the end surface 228 mates with a second mounting surface 330. Moreover, it should be noted that the face 230 of the removable insert 200 is generally co-planar with the side wall 56. The side wall 56 includes threaded holes 310, 312, and 316 which receive the fasteners 270. Further, the side wall 56 includes alignment pin holes 314 to receive the alignment pins 250.

Figure 8:
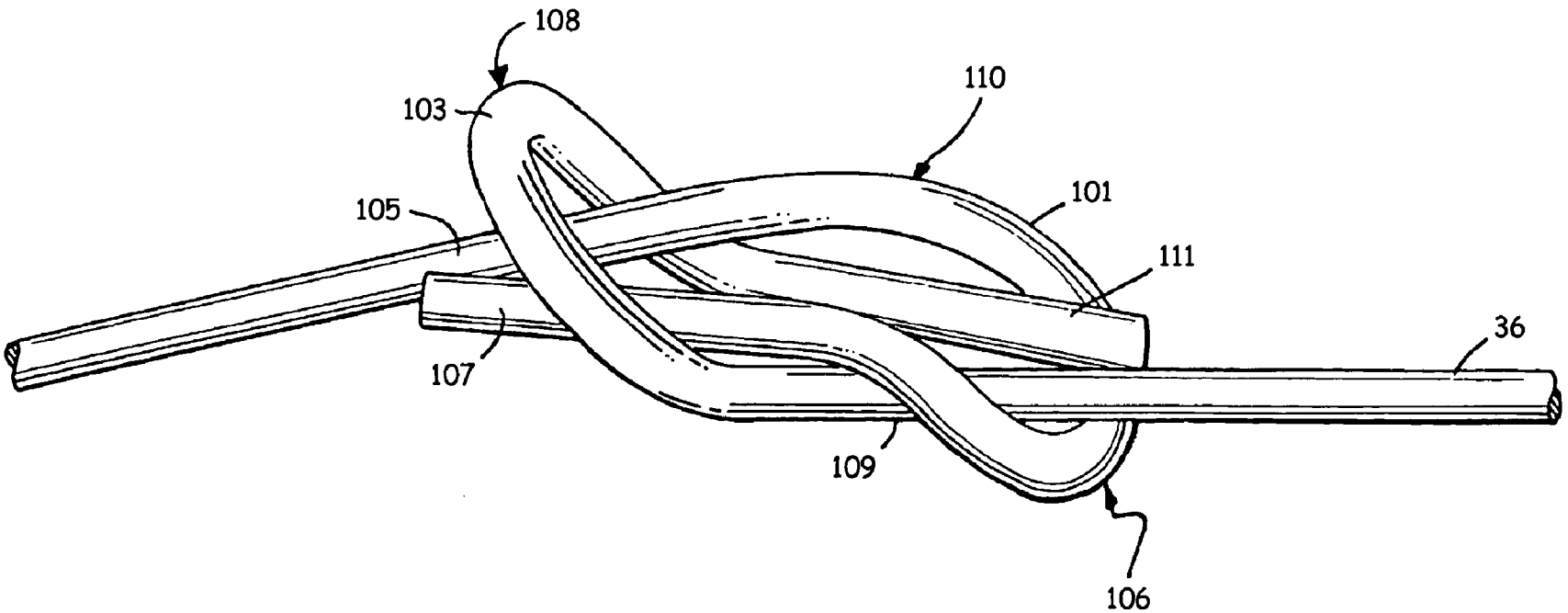
FIG. 8 is a perspective view of the looped ends of a piece of wire tie after they have been brought together and engaged in a knot.

Referring to FIG. 8, the wire tie 36 is preferably a wire tie commercially available as "CAR-LOK" waisted wire from International Fiber Packaging of Kennesaw, Ga. The wire tie 36 has a natural bias tending to bend the wire tie 36 in a circular direction such that the looped ends 106, 108 are biased toward each other. The wire tie 36 has a first looped end 106 with a ski toe portion 101 angled downward and to the right, and the ski toe portion 101 has a main longer leg 105 and a shorter leg 107 forming the looped end 106. The opposite, second looped end 108 of the wire tie 36 has a ski toe portion 103 angled upward and to the right, and the ski toe portion 103 has a main, longer leg 109 and a shorter leg 111 forming a looped end 108 forming the looped end 108. As the looped ends 106, 108 are pushed together, they engage to form a knot 110 in a well known manner as will be shown and described.

In use, referring to FIG. 2, the baling press 20 is initially open and material to be compressed or compacted is loaded into the press. The baling press 20 is then operated to move the upper platen 24 toward the lower platen 22, thereby compacting the material into a bale 28. The bale must now be bound or tied so that it remains in the compressed state when the press is opened.

Referring to FIGS. 2–7, the first looped end 106 is first fed into the front end 50 of the wire guide member 44 in the upper platen 24, through the channel section 48, out the rear end of the wire guide member 44 into the curved path 40 of the chute 38 (FIG. 3). As the first looped end 106 moves around the curved path 40, it is aligned with the rear end of the channel 34 of the pass-through channel member 42 in the lower platen 22. The first looped end 106 passes through the channel 34 of the lower wire guide member 42 in the lower platen 22 and exits to the front 50 of the baling press 20.

Figure 9:
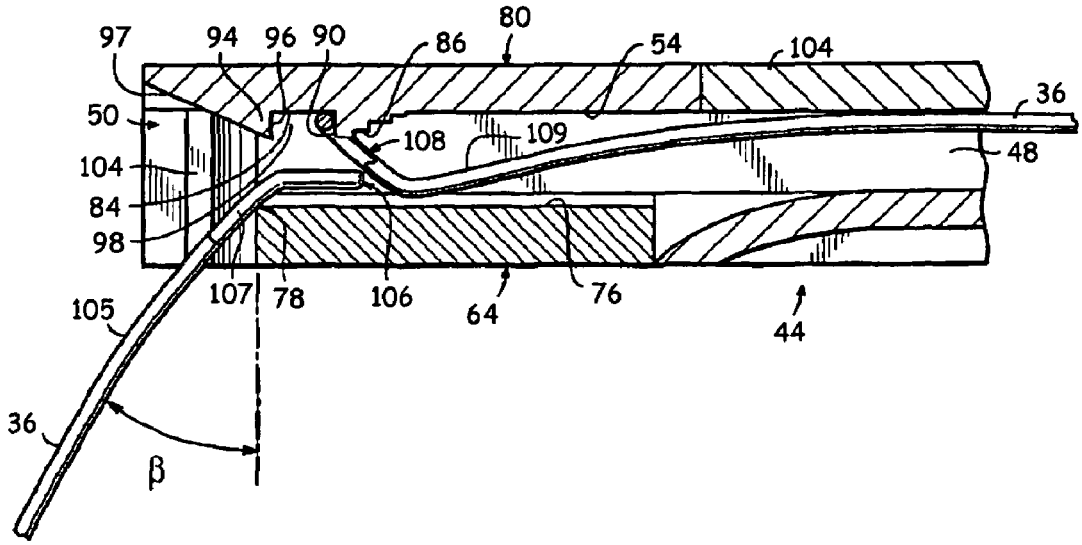
FIG. 9 is a cross-sectional view taken along line 9—9 of FIG. 4 and illustrates an initial location of the first looped end of the wire tie as it is inserted a second time in the wire guide in accordance with the principles of the present invention.

The operator then pulls on the first looped end 106, thereby feeding the second looped end 108 into the front end 50 of the upper wire guide member 44. The second looped end 108 contacts the angled or sloped forward surface 97 of the second stop 94. The second looped end 108 rides up the surface 97 and then drops into the notch 98 and over the first stop 86 as shown in FIG. 9. The forward directed surface 90 (FIG. 4) of the first stop 86 prevents the second looped end 108 from moving toward the rear of the upper wire guide member 44. However, the wire tie 36 is held in a relatively straight configuration throughout the length of the channel 48 in the upper wire guide member 44. The natural curved bias of the wire tie 36 has a tendency to hold the second looped end 108 upward.

Referring to FIG. 8, to reliably make a proper knot 110, it is important that the first looped end 106 guide over the longer, main leg 109 of the stationary looped end 108. If the looped end 106 guides over the shorter leg of the loop 108, the loops 106, 108 will either not join at all or, they will join as two fish hooks, that is, with only their short legs looped together. In either event, the process must be repeated until a proper knot 110 is formed. To facilitate the proper tying of a knot, the wire guide member 44 has a lateral projection 104 to properly direct the first looped end 106 with respect to the stationary looped end 108. The lateral projection 104 provides a limited opening through which the first looped end 106 can be inserted. The shorter leg 111 (FIG. 8) of the stationary second looped end 108 is partially behind the lateral projection 104, and thus, the lateral projection 104 serves to orient the first looped end 106 with respect to the main, longer leg of the second looped end 108, so that the looped end 106 is guided over the longer leg of the looped end 108 to reliably and properly engage to form the knot 110.

The first looped end 106 is again inserted in the front end 50 of the wire guide member 44. As shown in FIG. 9, the first looped end 106 is first located against the inner forward edge 78 of the door 64 so that the wire tie 36 is at a relatively small angle Beta with respect to a vertical direction, for example, approximately 30 degrees. Consequently, the wire can be inserted using the natural curve of the wire, and little or no bending of the wire tie is required to insert and locate the wire tie 36 on the forward edge 78 of the door 64. Thereafter, using the front edge 78 of the door 64 as a fulcrum or guide edge, a generally longitudinal pushing force is applied to the wire tie 36 adjacent the first looped end 106 while moving the wire tie over the inner forward edge 78 of the door 64. With that motion, the first looped end 106 moves into contact with the second looped end 108 and pushes the second looped end 108 up against the top surface 84 of the notch 98. With a continued pushing force, the first looped end 106 is guided over the main, longer leg of the stationary second looped end 108. In this process, the user may also guide the looped end 106 against the inner surface 100 of the side wall 56, thereby using the surface 100 as a lateral guide.

Figure 10:
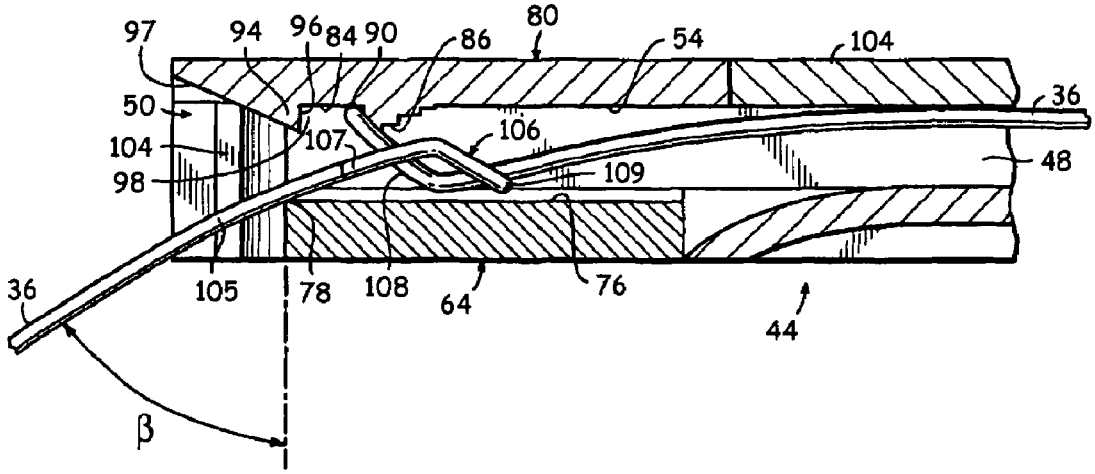
FIG. 10 is a cross-sectional view taken along line 9—9 of FIG. 4 and illustrates a second location of the first looped end with the second looped end in which the first looped end pushes the second looped end against the top wall in accordance with the principles of the present invention.
Figure 11:
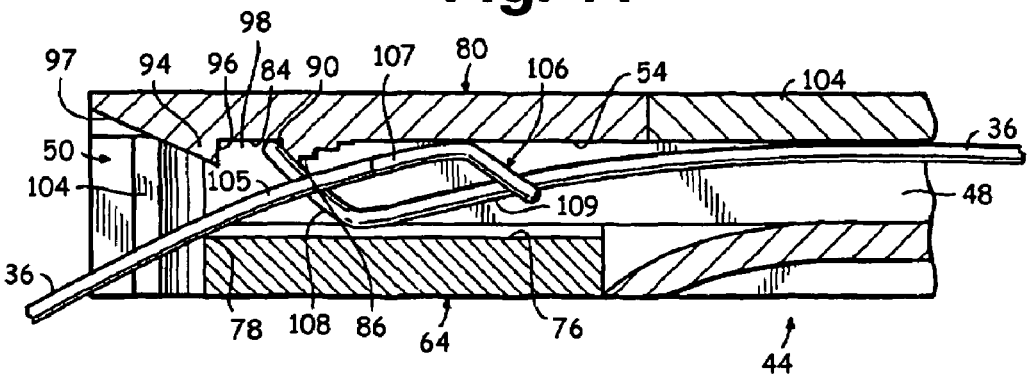
FIG. 11 is a cross-sectional view taken along line 9—9 of FIG. 4 and illustrates a third location of the first looped end with the second looped end in which the first looped end engages with the second looped end to form the knot in accordance with the principles of the present invention.
Figure 12:
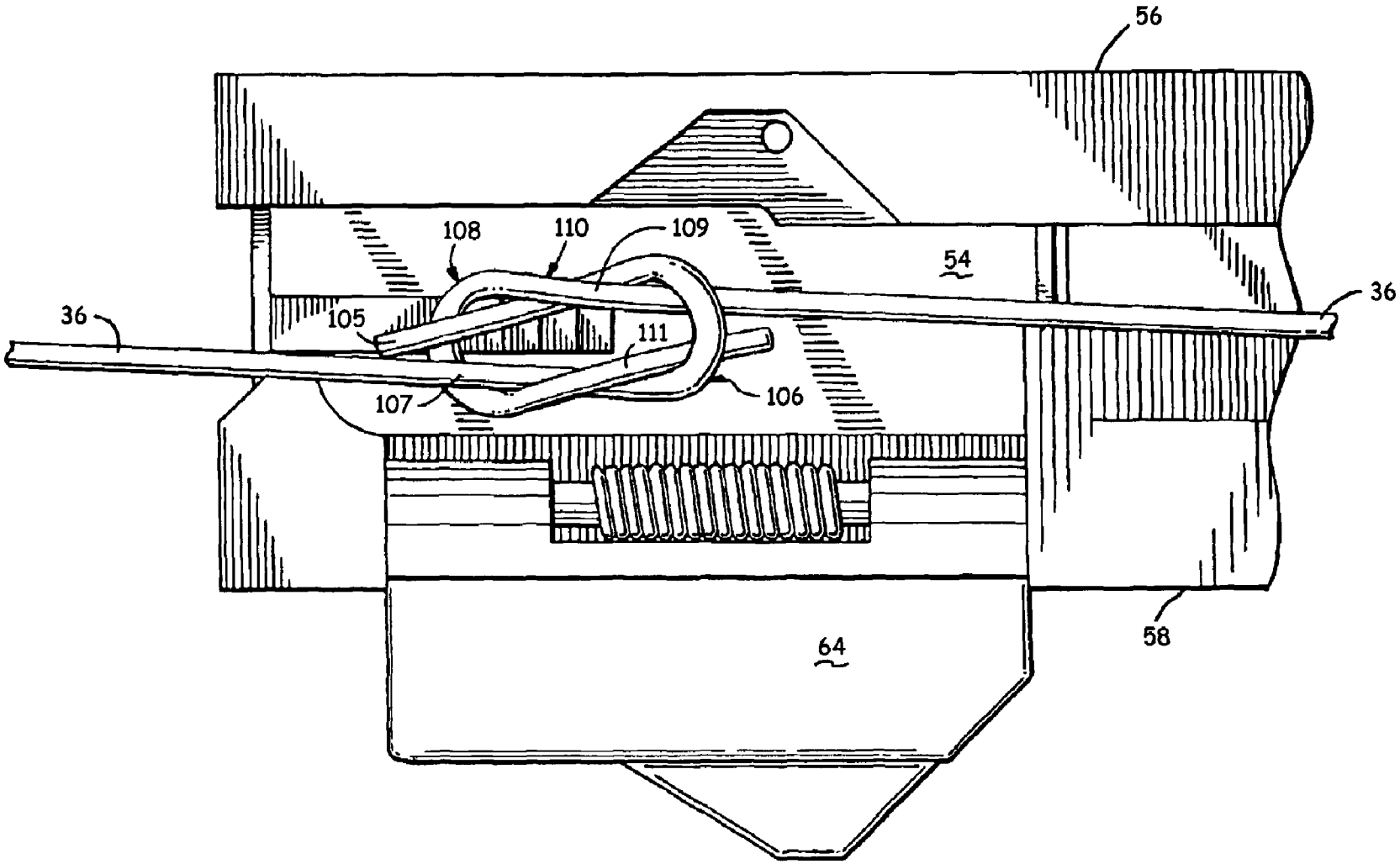
FIG. 12 is a lower planar view illustrating the wire guide member with the door open and the knot of looped ends tightened against the second stop in accordance with the principles of the present invention.

As shown in FIG. 10, while using the edge 78 as a fulcrum and guide, the longitudinal pushing force on the wire tie 36 moves the looped end 106 upward and rearward, and the wire tie 36 naturally bends as it is guided over the main, longer leg of the stationary looped end 108 to an angle Beta of approximately 45 degrees with the vertical direction. Thus, the bending of the wire tie 36 is a result of structure of the wire tying guide member 44 and the longitudinal pushing of the user. The user is not required to bend the wire tie in the knot-tying process. Continued application of the longitudinal pushing force on the wire tie 36 results in the first looped end 106 continuing to be guided by the main, longer leg of the stationary loop 108 as it moves rearward in the channel 48 as shown in FIG. 11. During this motion, the first looped end 106 properly engages with the stationary second looped end 108 to form the knot 110. During the travel of the first looped end 106 through the channel 48, it is maintained above and out of contact with the unobstructed inner surface 76 of the door 64. Thereafter, the wire tie 36 at the first looped end 106 is pulled to move the first looped end 106 forward in the channel 48. That action also moves the second looped end 108 in the forward direction until it contacts the rearward directed surface 96 of the second stop 94 as shown in FIG. 12. Thus, continued pulling on the wire tie 36 causes the knot 110 formed by the looped ends 106, 108 to tighten.

After all of the wire ties have been knotted around the bale, the operator operates the hydraulic system 26 (FIG. 2) of the baling press 20 to move the upper platen 24 away from the lower platen 22. As the upper platen moves away from the bale 28, the wire tie 36 is released from the upper tying device 44 through the wire tie discharge passage 62. In addition, the knot formed by the looped ends 106, 108 pushes the door 64 downward. The door pivots open, thereby releasing the knotted looped ends 106, 108, and thereafter, the spring 70 biases the door 64 back to its closed position against the removable wear insert 200.

As the baling machine cycles and numerous bales of fibrous materials are baled, the door 64 will continually snap tight against the removable wear insert 200, thereby causing the removable wear insert 200 to wear. After a sufficient number of baling machine cycles, the removable wear insert 200 will be worn out and need to be replaced. Replacement of the removable wear insert 200 should restore the knot discharge chamber approximately to its original size. The removable wear insert 200 should allow a user to schedule maintenance for the baling machine due to the predictable wear rate of the removable wear insert 200. As such, costly unscheduled work stoppage can be avoided.

The tying device of the present invention permits opposed looped ends 106, 108 of the wire tie 36 to be knotted with minimal operator effort. As has been illustrated, the insertion of the first looped end 106 into the wire guide member 44 is accomplished with very little, if any, bending of the wire tie 36 adjacent the first looped end 106. Further, after repeated uses, it is possible for one of the stops 86, 94 to wear or break. In that event, it is a relatively simple process to remove the tying device 44 from the platen 24 and remove the removable plate 80 with the defective stop. A new plate is then easily installed and the wire guide member 44 returned to active service in a short time and at minimal cost. Thus, the wire guide member of the present invention provides a simple, durable, low cost structure that provides a very user friendly operation.

While the invention has been set forth by a description of the preferred embodiment in considerable detail, it is not intended to restrict or in any way limit the claims to such detail. Additional advantages and modifications will readily appear to those who are skilled in the art. For example, while the baling press is described as having an upper platen 24 moving with respect to a lower platen 22, other baling presses have an opposite configuration in which a lower platen moves with respect to an upper platen. In those applications, the wire tying guide member 44 would be mounted in the lower platen, and the other pass-through wire guide member 42 would be mounted in the upper platen. In other applications, a horizontal press may be used in which a movable platen moves in a horizontal direction towards and away from a stationary platen. In those applications, the wire tying guide member 44 may be mounted in either the movable or stationary platen and on either the right hand side or the left hand side of the press.

In the described embodiment, the stops 86, 94 are described as being mounted on a removable plate 80. As will be appreciated, if the plate 80 is not utilized, the stops 86, 94 are mounted on the top wall 54 extending to the front end 50 of the wire guide member 44. As will be appreciated, the wire guide member 44 may be machined from a solid, or fabricated by joining separate component parts in a known manner.

There is also provided a method of assembling a baling wire tying device. The baling wire tying device is used to facilitate guiding a wire tie around a bale of material being compressed between upper and lower platens of a baling press wherein the wire tie has pre-formed looped ends being engageable with each other to form a knot by moving one looped end relative to an opposite looped end. The method comprises the steps of: mounting a wire guide member on the upper platen of the baling press, the wire guide member including a top wall and side walls depending laterally from the top wall to form an elongated, longitudinally extending generally U-shaped channel, the channel having forward and rearward end portions, and a bottom wall intersecting one of the side walls to form a longitudinally extending wire discharge passage contiguous with the channel; pivotally mounting a door to one of the side walls at the forward end portion of the channel, the door in a closed position having an unobstructed inner surface substantially parallel to the top wall and extending across the discharge passage to form a portion of the bottom wall, and the door having an inner, forward edge extending generally perpendicular to the side walls for guiding the wire tie into the channel; and mounting a removable wear insert to one of said side walls at the forward end portion and having a cutout adapted to receive at least a portion of the door.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A baling wire tying device to facilitate guiding a wire tie around a bale of material being compressed between upper and lower platens of a baling press wherein the wire tie has pre-formed looped ends being engageable with each other to form a knot by moving one looped end relative to an opposite looped end, the tying device comprising:

a. a wire guide member adapted to be mounted on the upper platen of the baling press, the wire guide member including a top wall and side walls depending laterally from the top wall to form an elongated, longitudinally extending generally U-shaped channel, the channel having forward and rearward end portions, and a bottom wall intersecting one of the side walls to form a longitudinally extending wire discharge passage contiguous with the channel;

b. a door pivotally mounted proximate to one of the side walls at the forward end portion of the channel, the door in a closed position having an unobstructed inner surface substantially parallel to the top wall and extending across the discharge passage to form a portion of the bottom wall, and the door having an inner, forward edge extending generally perpendicular to the side walls for guiding the wire tie into the channel; and c. a removable wear insert mounted to one of said side walls at the forward end portion of the channel and having a cutout adapted to receive at least a portion of the door.

2. The baling wire tying device of claim 1, wherein the removable wear insert is mounted to one of said side walls through the use of a plurality of fasteners and a plurality of alignment pins.

3. The baling wire tying device of claim 1, wherein said cutout of said removable wear insert includes a contact surface and said door engages said contact surface when said door is in a closed position.

4. The baling wire tying device of claim 1, further comprising alignment pins mounted to one of said side walls, said alignment pins adapted to locate said removable wear insert.

5. A baling wire tying device to facilitate guiding a wire tie around a bale of material being compressed between upper and lower platens of a baling press wherein the wire tie has pre-formed looped ends being engageable with each other to form a knot by moving one looped end relative to an opposite looped end, the tying device comprising:

a. a wire guide member adapted to be mounted on the upper platen of the baling press, the wire guide member including a top wall and side walls depending laterally from the top wall to form an elongated, longitudinally extending generally U-shaped channel, the channel having forward and rearward end portions, and a bottom wall intersecting one of the side walls to form a longitudinally extending wire discharge passage contiguous with the channel;

b. a door pivotally mounted proximate to one of the side walls at the forward end portion of the channel, the door in a closed position having an unobstructed inner surface substantially parallel to the top wall and extending across the discharge passage to form a portion of the bottom wall, and the door having an inner, forward edge extending generally perpendicular to the side walls for guiding the wire tie into the channel;

c. a first stop located on the top wall at the forward end portion of the channel opposite the forward edge of the door, the first stop having a forward directed wall depending from the top wall into the channel and adapted to receive a looped end of the wire tie; and d. a replaceable wear insert mounted to one of said side walls at the forward end portion of the channel and having a cutout adapted to receive at least a portion of the door.

6. The baling wire tying device of claim 5, wherein the first stop is mounted on a removable plate attachable to the wire guide member and forming part of the top wall at the forward end portion of the channel.

7. The baling wire tying device of claim 5, further comprising a second stop located on the top wall forward of the first stop, the second stop having a rearward directed wall depending from the top wall into the channel and forming a notch with the forward directed wall of the first stop to prevent the looped end of the wire tie on the first stop from moving toward the forward end portion of the channel.

8. The baling wire tying device of claim 5, further comprising a lateral projection mounted forward of the stop and partially obstructing the channel in a direction generally perpendicular to the top wall for limiting an opening to the channel.

9. The baling wire tying device of claim 5, wherein the first stop has a plurality of surfaces extending serially rearward from the forward directed surface to form a series of steps that intersect the top wall of the channel.

10. A baling wire tying device to facilitate guiding a wire tie around a bale of material being compressed between upper and lower platens of a baling press wherein the wire tie has pre-formed looped ends being engageable with each other to form a knot by moving one looped end relative to an opposite looped end, the tying device comprising:

a. a wire guide member adapted to be mounted on the upper platen of the baling press, the wire guide member including a top wall and side walls depending laterally from the top wall to form an elongated, longitudinally extending generally U-shaped channel, the channel having forward and rearward end portions, and a bottom wall intersecting one of the side walls to form a longitudinally extending wire discharge passage contiguous with the channel;

b. a door pivotally mounted proximate the one of the side walls at the forward end portion of the channel, the door in a closed position having an unobstructed inner surface substantially parallel to the top wall and extending across the discharge passage to form a portion of the bottom wall, and the door having an inner, forward edge extending generally perpendicular to the side walls for guiding the wire tie into the channel;

c. a removable plate attachable to the wire guide member and forming part of the top wall at the forward end portion of the channel, the plate including a first stop located on the top wall at the forward end portion of the channel opposite the forward edge of the door, the first stop having a forward directed wall depending from the top wall into the channel and adapted to receive a looped end of the wire tie, and a second stop located on the top wall forward of the first stop, the second stop having a rearward directed wall depending from the top wall into the channel and forming a notch with the forward directed wall of the first stop to prevent the looped end of the wire tie on the first stop from moving toward the forward end portion of the channel;

d. a lateral projection mounted forward of the second stop and partially obstructing the channel in a direction generally perpendicular to the top wall; and e. a replaceable wear insert mounted to one of said side walls at the forward end portion of the channel and having a cutout adapted to receive at least a portion of the door.

11. In a baling wire tying device having upper and lower platens, a plurality of wire guide members mounted to the upper platens, each of the plurality of wire guide members having a top wall and side walls depending laterally from the top wall to form an elongated, longitudinally extending generally U-shaped channel, the channel having forward and rearward end portions, a bottom wall intersecting one of the side walls to form a longitudinally extending wire discharge passage contiguous with the channel, and a door pivotally mounted proximate to one of the side walls at the forward end portion of the channel, the door in a closed position having an unobstructed inner surface substantially parallel to the top wall and extending across the discharge passage to form a portion of the bottom wall, and the door having an inner, forward edge extending generally perpendicular to the side walls for guiding the wire tie into the channel, the improvement comprising a removable wear insert mounted to one of the side walls of the wire guide member at the forward end portion of the channel and having a cutout adapted to receive at least a portion of the door.

12. A method of assembling a baling wire tying device to facilitate guiding a wire tie around a bale of material being compressed between upper and lower platens of a baling press wherein the wire tie has pre-formed looped ends being engageable with each other to form a knot by moving one looped end relative to an opposite looped end, the method comprising the steps of:

a. mounting a wire guide member on the upper platen of the baling press, the wire guide member including a top wall and side walls depending laterally from the top wall to form an elongated, longitudinally extending generally U-shaped channel, the channel having forward and rearward end portions, and a bottom wall intersecting one of the side walls to form a longitudinally extending wire discharge passage contiguous with the channel;

b. pivotally mounting a door to one of the side walls at the forward end portion of the channel, the door in a closed position having an unobstructed inner surface substantially parallel to the top wall and extending across the discharge passage to form a portion of the bottom wall, and the door having an inner, forward edge extending generally perpendicular to the side walls for guiding the wire tie into the channel; and c. mounting a removable wear insert to one of said side walls at the forward end portion of the channel and having a cutout adapted to receive at least a portion of the door.

* * * * *